US005111892A

United States Patent [19]

Sinor et al.

[11] Patent Number: 5,111,892

[45] Date of Patent: May 12, 1992

[54] IMBALANCE COMPENSATED DRILL BIT WITH HYDROSTATIC BEARING

[76] Inventors: L. Allen Sinor, 2250 S. Oswego Pl., Tulsa, Okla. 74114; Tommy M. Warren, Rte. 1, Box 130-10, Coweta, Okla. 74429

[21] Appl. No.: 592,151

[22] Filed: Oct. 3, 1990

[51] Int. Cl.[5] ..... E21B 10/60

[52] U.S. Cl. ..... 175/65; 175/371; 175/393

[58] Field of Search ..... 175/65, 371, 337, 339, 175/340, 393, 417, 418

[56] References Cited

U.S. PATENT DOCUMENTS 2,807,443 9/1957 Wyman ..... 175/418
4,515,227 5/1985 Cerkoknik ..... 175/65
4,696,354 9/1987 King et al. ..... 175/393 X

*Primary Examiner*—Thuy M. Bui
*Attorney, Agent, or Firm*—Scott H. Brown; Fred E. Hook

[57] ABSTRACT

A subterranean drill bit is provided that comprises a drill bit body having a base portion disposed about a longitudinal bit axis, a gauge portion disposed about the bit axis and extending from the base portion, and a face portion disposed about the bit axis extending from the gauge portion. The drill bit further includes a plurality of cutting elements fixedly disposed on and projecting from the face portion and spaced from one another. A hydrostatic bearing is disposed in the gauge portion to create a hydrostatically lubricated low friction zone that facilitates rotation of the drill bit without gripping of rotation of the drill bit is thereby maintained substantially at one location on the drill bit, which avoids backwards whirling and provides stable bit rotation.

9 Claims, 9 Drawing Sheets

IMBALANCE COMPENSATED DRILL BIT WITH HYDROSTATIC BEARING

BACKGROUND OF THE INVENTION

1. Field of the Invention

The invention relates to subterranean drill bits such as those used for subterranean mining and for drilling of subterranean oil and gas wells, and related methods.

2. Description of Related Art

In subterranean drilling such as in the exploration and production of hydrocarbons, a rotating drill bit is used to create a borehole through the subsurface formations of the earth. Although a number of subterranean drill bit designs are known in the art, such designs may be broadly classified into two areas—(1) roller cone bits and (2) fixed cutter bits. The present invention is directed principally to fixed cutter bits. The term fixed cutter drill bits as used in this document refers to subterranean drill bits in which the position of the cutting surface of the cutting elements or cutters is fixed relative to the drill bit body. Although the specific design and physical appearance of fixed cutter drill bits can vary considerably, such drill bits share a number of common features. The International Association of Drilling Contractors (IADC) recently adopted a fixed cutter bit classification system based on such common features. See, e g., W. J. Winters and N. H. Doiron, "The 1987 IADC Fixed Cutter Bit Classification System," presented at the 1987 Society of Petroleum Engineers (SPE/IADC) Drilling Conference held in New Orleans, La. on Mar. 15-18, 1987.

In recent years, fixed cutter subterranean drill bit designs using diamond materials for the cutting medium have gained widespread use in the oil and gas industry, particularly for use in subterranean formations having relatively soft to medium hardness. The cutting medium in these fixed cutter diamond drill bits typically comprises natural diamond, a polycrystalline diamond compact material, or a thermally-stable poly-crystalline diamond material. Fixed cutter diamond drill bits typically include a significant number of diamond cutters distributed over the drill bit body. Although fixed cutter diamond drill bits are relatively expensive, their superior rate of penetration (ROP) (the rate at which the drill bit drills through the subterranean earthen materials) has increased their demand and made them indispensable for some applications. Notwithstanding the popularity of fixed cutter subterranean drill bits, there has been a real concern in the industry about their susceptibility to breakage. The users of the drill bits and the drill bit manufacturers have found that, by controlling more precisely the weight-on-bit (WOB) and increasing the rotational speed (RPM), increased penetration rates can be achieved. As the RPM is increased, the drill bit effective lifetime has decreased dramatically because the cutting elements on the drill bit become damaged and occasionally are violently torn from the bit body. As the cutting elements break, the penetration rate of the bit decreases. When the penetration rate falls unacceptably low, the drill bit must be withdrawn from the borehole and replaced. The drill bit can also fail catastrophically, which also requires bit replacement. The lifetimes of the drill bits can vary considerably. It is not unknown for subterranean drill bits to catastrophically fail when they are virtually new. The cost effectiveness of subterranean drilling is directly dependent upon maintaining good penetration rates and on prolonging drill bit lifetime. Replacement of drill bits is a very expensive process given the cost of operating the drilling rigs, the time required to withdraw the drill bit from the borehole, replace it, and reinsert the drill bit, and the cost of the bits themselves.

Prior attempts to improve fixed cutter subterranean drill bit durability have been closely associated with the prevailing theories of cutting element wear and drill bit failure. During the 1970s and early 1980s, the prevailing theories of cutter wear and bit failure focused primarily on heat buildup in the cutting elements. Heat buildup was believed to cause the individual cutting elements to undergo accelerated wear. Accordingly, attempts to improve drill bit durability during this time frame focused on decreasing heat buildup on the cutting elements, for example, by improving the hydraulic design of the drill bit to better cool the cutting elements.

Another theory of cutter wear and drill bit failure prevalent during the 1970s and early 1980s involved the degree of balance inherent in the drill bit. More specifically, research efforts indicated that drill bit failure was accompanied by damage to the cutting elements whereby the diamond material was chipped or broken off of its carbide support. Given the number and positioning of the cutting elements on the bit body, this cutting element damage was believed to create unbalanced lateral or radial forces on the drill bit that forced the bit body to impact the borehole wall and further damage the drill bit. Accordingly, attempts to improve drill bit durability also included efforts to balance the drill bit so that the combined or net lateral forces on the bit during its rotation in drilling were balanced.

Various approaches were also used to strengthen the individual cutting elements, such as using beveled, domed, or high back rake cutters, using larger stud support materials for the cutters, using posts behind the cutters, and increasing the amount of diamond material on each cutting element.

Although some improvements in bit durability resulted from these efforts, a satisfactory solution to the cutter breakage problem was not found.

OBJECTS OF THE INVENTION

Accordingly, an object of the invention is to provide a subterranean drill bit that has improved durability and operating lifetime.

Another object of the invention is to provide a method for using a subterranean drill bit that provides for improved durability and operating lifetime of the drill bit.

Additional objects and advantages of the invention will be set forth in part in the description which follows, and in part will be apparent from the description, or may be learned by practice of the invention. The objects and advantages of the invention may be realized and attained by means of the elements and combinations particularly pointed out in the appended claims.

SUMMARY OF THE INVENTION

The invention arose from the extensive research efforts of the inventors in addressing the problems of drill bit durability described above. The inventors, having discovered a new theory of drill bit breakage referred to as backwards bit whirl, set out to design a subterranean drill bit and related methods that took advantage of the new theory.

According to the backwards bit whirl theory, which is described in greater detail below, frictional forces between the gauge portion of a subterranean drill bit and the borehole wall cause the gauge portion to drag on, or grip, the borehole wall. This causes the instantaneous center of rotation of the drill bit to move on the face portion of the drill bit, from a location near the center of the face portion to a location near the gauge circumference where the drill bit body contacts the borehole wall. This is analogous to the case of a tire of a car rotating on dry pavement, in which the center of rotation of the tire is the point at which the tire contacts the pavement, rather than the axle of the car. This movement of the instantaneous center of rotation on the drill bit causes the drill bit to backwards whirl, which causes the drill bit to destructively impact the borehole wall.

Through their research, the inventors have discovered that backwards whirling largely can be prevented by reducing the frictional forces between the gauge portion of the drill bit and the borehole wall. The inventors have further discovered that a subterranean drill bit that is designed to have a non-zero radial imbalance force directed in a stable equilibrium direction, and which has essentially zero friction between the borehole wall and the region of the gauge portion corresponding to the equilibrium direction, demonstrates significantly improved performance over known fixed cutter drill bit designs.

Accordingly, to achieve the objects and in accordance with the purpose of the invention as embodied and broadly described in this document, a subterranean drill bit is provided that comprises a drill bit body having a base portion disposed about a longitudinal bit axis, a gauge portion disposed about the bit axis and extending from the base portion, and a face portion disposed about the bit axis extending from the gauge portion. The drill bit of the invention also includes a plurality of cutting elements fixedly disposed on and projecting from the face portion and spaced from one another, and a hydrostatic bearing disposed in the gauge portion.

The cutting elements preferably are disposed for creating a net radial imbalance force vector substantially perpendicular to the longitudinal bit axis, and the hydrostatic bearing preferably is disposed in the gauge portion at a location corresponding to the net radial imbalance force vector for hydrostatically spacing the gauge portion from the borehole wall during the drilling. In accordance with another aspect of the invention, the hydrostatic bearing is disposed in the gauge portion in a force plane formed by the intersection of the bit axis and the net radial imbalance force vector for hydrostatically spacing the gauge portion from the borehole wall during the drilling.

The hydrostatic bearing preferably comprises a recessed area and a flow port. Preferably, the drill bit body includes an internal fluid flow channel, and the hydrostatic bearing is operatively coupled in fluid communication with the flow channel. The hydrostatic bearing may include a diffuser.

The design of a drill bit in accordance with the invention is such that the drill bit remains stable not only for stable, uniform drilling conditions, but is also dynamically stable in the event of disturbing displacements. The direction of the net radial imbalance force vector substantially returns to a location corresponding to the location of the hydrostatic bearing even in the event of such disturbing displacements.

Accordingly, the cutting elements preferably are disposed on the drill bit body to cause the net radial imbalance force to substantially maintain the hydrostatic bearing at the borehole wall during the drilling, to cause the net radial imbalance force vector to have an equilibrium direction, and to cause the net radial imbalance force vector to return substantially to the equilibrium direction in response to a disturbing displacement.

Further in accordance with the invention, a method is provided for drilling in subterranean earthen materials to create a borehole having a borehole wall. The method comprises providing a subterranean drill bit including a drill bit body having a base portion disposed about a longitudinal bit axis, a gauge portion disposed about the bit axis and extending from the base portion, a face portion disposed about the bit axis extending from the gauge portion, and an internal fluid flow channel. A plurality of cutting elements are fixedly disposed on and project from the face portion and are spaced from one another. A hydrostatic bearing is disposed in the gauge portion. The hydrostatic bearing preferably is disposed in the gauge portion at a location corresponding to a net radial imbalance force vector and in fluid communication with the flow channel. The method further includes rotating the drill bit, and pressurizing a fluid in the flow channel to force the fluid out the hydrostatic bearing toward the borehole wall.

BRIEF DESCRIPTION OF THE DRAWINGS

The accompanying drawings, which are incorporated in and constitute a part of this specification, illustrate a preferred embodiment and method of the invention and, together with the description, serve to explain the principles of the invention.

DETAILED DESCRIPTION OF THE PREFERRED EMBODIMENT AND METHOD

Figure 1A:
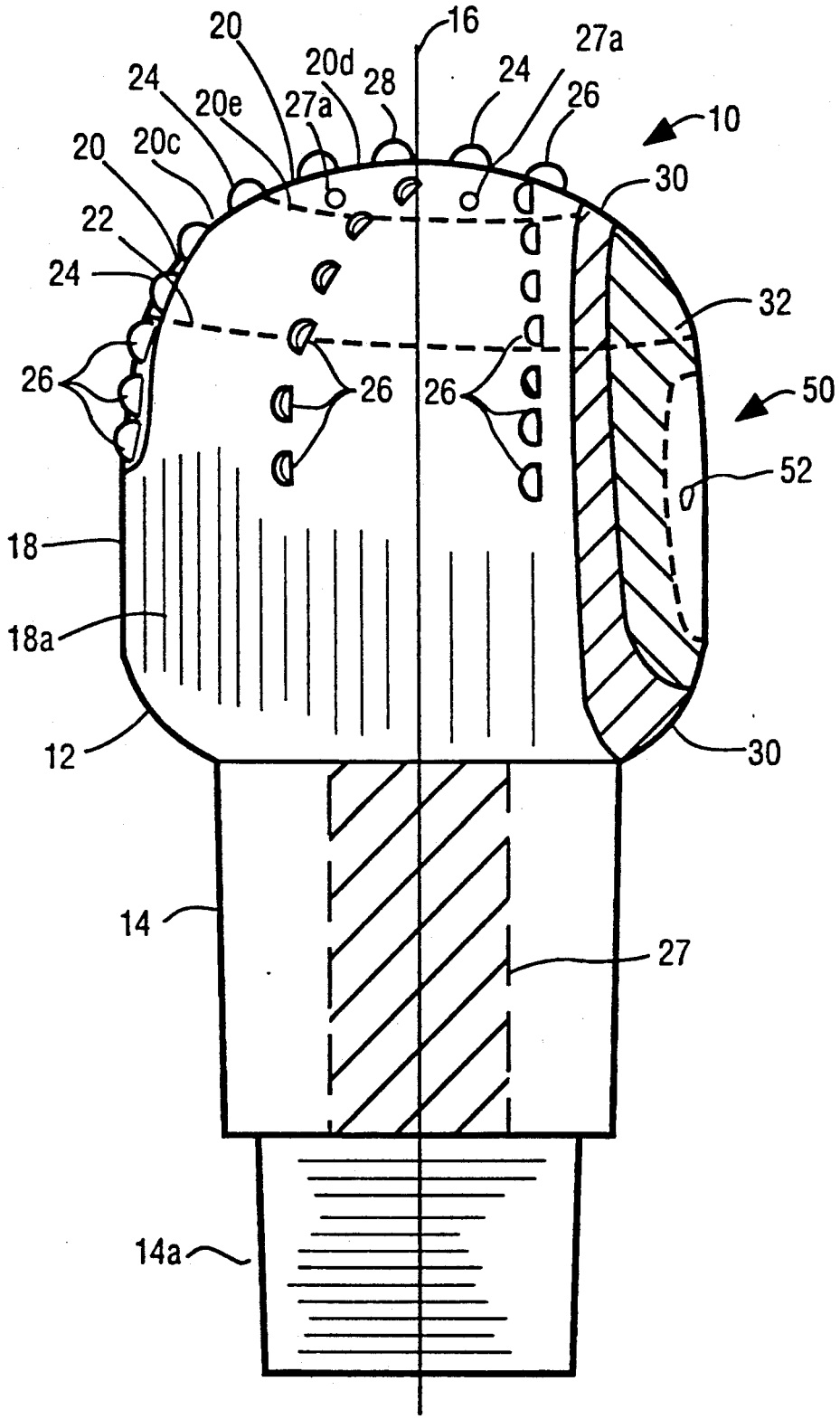
FIG. 1A shows a side view of a subterranean drill bit in accordance with the preferred embodiment of the invention.

The preferred embodiment and method of the invention will now be described with reference to the drawings, in which like reference characters refer to like or corresponding parts throughout the drawings.

In accordance with the invention, a subterranean drill bit is provided, for example, for subterranean drilling of oil and gas wells or subterranean mining. The subterranean drill bit is operable with a rotational drive source, not shown in the drawings, for drilling in subterranean earthen materials to create a borehole having a borehole wall. The rotational drive source may comprise a commercially available drilling rig with a drillstring or downhole motor suitable for connection to commercially available subterranean drill bits.

Further in accordance with the invention, the subterranean drill bit includes a drill bit body having a base portion disposed about a longitudinal bit axis, a gauge portion disposed about the bit axis and extending from the base portion, and a face portion disposed about the bit axis and extending from the gauge portion. The base portion, gauge portion, and face portion preferably form a unitary drill bit body.

Figure 1B:
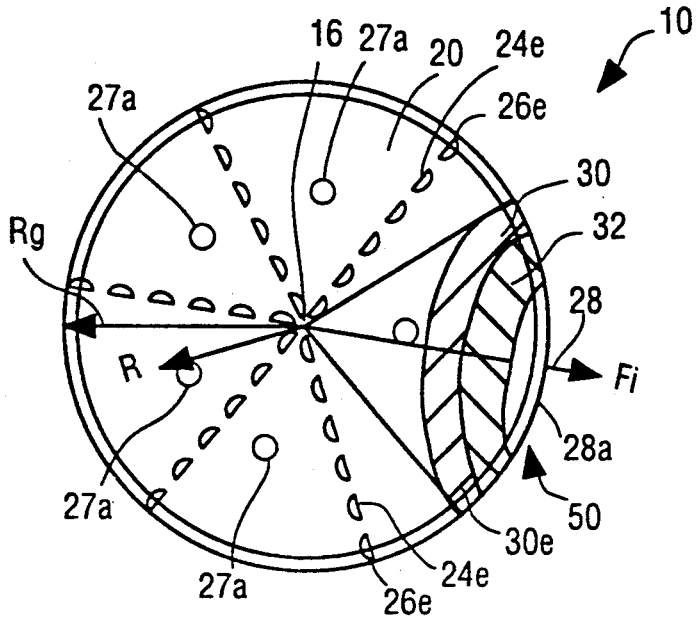
FIG. 1B shows a face or longitudinal view of the subterranean drill bit shown in FIG. 1A.

A preferred embodiment of the subterranean drill bit according to the invention, designated by reference numeral 10, is shown in FIGS. 1A and 1B. FIG. 1A shows a side view, and FIG. 1B shows a face or longitudinal view, corresponding to a view of an operational drill bit taken from the bottom of the borehole. Drill bit 10 includes a drill bit body 12 having a cylindrical shank or base portion 14 disposed about a longitudinal bit axis 16 for receiving the rotational drive source. Base portion 14 includes a threaded pin **14*a* that can be connected in a known manner to a drillstring that constitutes part of the rotational drive source. Longitudinal bit axis 16, a theoretical construct used for reference purposes and for ease of illustration, extends through the center of base portion 14 substantially parallel to the drillstring. Radial dimension, as the term is used in this document, refers to positions located or measured perpendicularly outward from longitudinal bit axis 16, for example, as shown in FIG. 1B**.

Drill bit body 12 has a substantially cylindrical gauge portion 18 disposed about bit axis 16 and extending from base portion 14 that includes a cylindrical wall substantially parallel to bit axis 16. Because of the substantially cylindrical shape of gauge portion 18, the gauge portion has a constant gauge radius $R_g$ measured radially outward and perpendicularly from longitudinal bit axis 16 to the surface of the gauge portion, as shown in FIG. 1B. Gauge portion 18 preferably includes a plurality of fluid courses **18*a* extending parallel to bit axis 16** to facilitate the removal of rock flower, drilling mud, and debris.

Drill bit body 12 also includes a face portion 20 disposed about bit axis 16 and extending from gauge portion 18. Gauge portion 18 and face portion 20 can be considered to meet at a line 22 (FIG. 1A) at which the radius of the drill bit body begins to transition from having the constant gauge radius. Line 22 therefore represents the circumference of the gauge portion.

The drill bit body shown in FIG 1A has a curved profile, i.e., the cross-sectional profile of face portion 20, when viewed from a side view perpendicular to the bit axis (as shown in FIG. 1A), has a curve shaped surface profile. The face portion, when viewed from this perspective, may, for example, have a spherical, parabolic, or other curved shape. Such profiles, however, are not limiting. For example, the face portion may be flat. Alternatively, it may have a concave profile in which the face portion includes a concave region disposed about bit axis 16. The face portion may also include a plurality of curved blades.

In accordance with the invention, the subterranean drill bit further includes a plurality of cutting elements fixedly disposed on and projecting from the face portion and spaced from one another. The drill bit of the invention may also include a plurality of cutting elements spaced from the face portion cutting elements, fixedly disposed on, and projecting from the gauge portion. The cutting elements preferably are disposed to create a net radial imbalance force during the drilling along a net radial imbalance force vector substantially perpendicular to the bit axis.

As applied to the preferred embodiment of FIGS. 1A and 1B, drill bit 10 includes a plurality of diamond cutting elements or cutters 24 fixedly disposed on and projecting from face portion 20 and spaced from one another. Drill bit 10 also includes a plurality of gauge cutting elements 26 fixedly disposed on and projecting from the gauge portion. Gauge cutting elements 26 are spaced from face portion cutting elements 24 and are spaced from one another. Each of the cutting elements preferably comprises a poly-crystalline diamond compact material mounted on a support such as a carbide support. The cutting elements may, of course, include other wear resistant materials such as natural diamond and thermally stable polycrystalline diamond material. Individual ones of the cutting elements have a cutting edge for contacting the subterranean earthen materials to be cut. The length and geometry of cutting edge will depend on the specific design and application. The cutting edge is usually curved, e.g., circular in cross-section, but may be flat, chiseled, beveled, or domed. Cutting elements 24 and 26 typically are circular or substantially circular cutting elements, and have a diameter within the range of 0.25 to 2.0 inches, most typically 0.5 inches. In most applications, the dimensions of gauge cutting elements 26 are the same as those described above for face portion cutting elements 24, but this need not be the case for all applications.

As shown in FIG. 1B, the cutting elements 24 are positioned on face portion 20 in a linear pattern along the radial dimension on face portion 20. This is by way of illustration, however, and not by way of limitation. For example, the face portion cutting elements may be positioned in a nonlinear pattern along a radial dimension of the face portion to form a plurality of curved blades, or they may be positioned in a nonuniform pattern on the face portion.

As embodied in the drill bit of FIG. 1A, gauge cutting elements 26 are similar or identical to cutting elements 24. Cutting elements 26 are disposed on gauge portion 18 with their cutting edge at a uniform radial distance from bit axis 16 to define gauge radius R , as shown in FIG. 1B. As shown in FIG. 1A, cutting elements 26 preferably are aligned with corresponding ones of cutting elements 24, and two or more cutting elements 26 extend linearly along the gauge portion in the axial direction of the bit. These gauge cutters define the gauge or radial dimension of the borehole wall, and serve to finish the borehole wall. The gauge cutters prolong bit lifetime, given that gauge cutters closer to face portion 20 will wear faster than gauge cutters farther from the face portion so the gauge cutters wear in sequential rather than in simultaneous fashion.

The number of individual cutting elements on the drill bit can vary considerably within the scope of the invention, depending on the specific design of and application for the drill bit. Drill bit 10 preferably includes at least 15 individual cutting elements, but this is not limiting. For example, a drill bit having an outside diameter of 8.5 inches would usually have between 25–40 individual cutting elements, approximately 17 to 28 on the face portion and approximately 8 to 12 on the gauge portion. A 17.5 inch diameter bit might have over 100 separate cutting elements. It is known that commercially available drill bits used in subterranean drilling range from bore sizes of 2 inches to 25 inches, although the most widely used sizes fall within the range of 6.5 to 12.25 inches.

The cutting elements of drill bit 10 preferably are disposed for creating a net radial imbalance force during the drilling along net radial imbalance force vector $F_i$ (FIG. 1B) approximately perpendicular to the longitudinal bit axis. The magnitude and direction of net radial imbalance force vector $F_i$ will depend on the positioning and orientation of the cutting elements, e.g., the specific arrangement of cutting elements 24 and 26 on drill bit 10, and the shape of the drill bit as these factors influence cutter position. Cutter orientation includes back rake and side rake. The magnitude and direction of force vector $F_i$ also are influenced by a number of factors such as the specific design of the individual cutting elements, the weight-on-bit load applied to the drill bit, the speed of rotation, the depth of cut, and the physical properties of the materials being drilled.

Drill bit 10 includes an internal fluid flow channel 27, such as the drillstring bore, and a plurality of nozzles **27*a*, e.g., of known design, disposed on face portion 20 and in fluid communication with flow channel 27. Flow channel 27 and nozzles 27*a* provide a fluid such as drilling mud to face portion 20** of the drill bit during the drilling to lubricate and cool the drill bit and remove rock cuttings.

Drill bit 10 also includes a substantially continuous cutter devoid region 30 disposed on gauge portion 18 and on face portion 20. Cutter devoid region 30 comprises a substantially continuous region of gauge portion 18 and face portion 20 from which cutting elements and abrasive surfaces are absent. Cutter devoid region intersects and is disposed about force plane $P_f$, which is formed by longitudinal bit axis 16 and net radial imbalance force vector $F_i$. Force plane $P_f$ is a theoretical construct used for reference and illustrative purposes to identify locations on the bit body, e.g., the gauge portion, corresponding to the direction of net radial imbalance force vector $F_i$. For example and with reference to the drawings, force plane $P_f$ lies in the plane of the drawing sheet of FIG. 1A and extends outwardly from longitudinal bit axis 16 through the center of cutter devoid region 30. When the drill bit is viewed longitudinally as shown in FIG. 1B, plane $P_f$ emerges perpendicularly from the drawing sheet with its projection corresponding to net radial imbalance force vector $F_i$. Force plane $P_f$ is important because net radial imbalance force vector $F_i$ may not always intersect gauge portion 18. In some instances, force vector $F_i$ may extend outward radially from bit axis 16 at or near face portion 20 directly toward the borehole wall without passing through gauge portion 18. Even in these instances, however, the radial projection of the direction of force vector $F_i$ will correspond to a point or line on gauge portion 18 toward which the net radial imbalance force is directed, as seen in the longitudinal projection of FIG. 1B, and this point or line on gauge portion 18 lies within force plane $P_f$.

Cutter devoid region 30 extends the full longitudinal length of gauge portion 18, and further extends onto face portion 20 along the circumferential and radial dimensions. Cutter devoid region 30 preferably extends circumferentially along a maximum of 90% of the gauge circumference and, for many applications, extends along about 20% to 70% of the gauge circumference. Selected ones of cutting elements 24 and 26 can be positioned adjacent to cutter devoid region 30, for example, to increase the number of cutters on the drill bit and thereby improve its cutting efficiency.

Drill bit 10 further includes a substantially smooth sliding surface 32 disposed in cutter devoid region 30 about force plane $P_f$. Sliding surface 32 is disposed on gauge portion 18 within cutter devoid region 30. Sliding surface 32 may comprise the same material as other portions of drill bit body 12, or a relatively harder material such as a carbide material. In addition, sliding surface 32 may include a wear-resistant treatment 33, such as a coating or diamond impregnation, a plurality of diamond stud inserts, a plurality of thin diamond pads, or similar inserts or impregnation that improve its durability.

The specific size and configuration of sliding surface 32 will depend on the specific drill bit design and application. Generally, sliding surface 32 should have a curvature to match the intended curvature of the borehole to be drilled. Preferably, the sliding surface extends along substantially the entire longitudinal length of gauge portion 18 and extends circumferentially along no more than 90% of the gauge circumference. For most applications, the sliding surface will extend along about 20% to 70% of the gauge circumference but, in virtually all applications, the sliding surface extends along a minimum of about 20% of the gauge circumference.

Sliding surface 32 has a size sufficient to encompass net radial imbalance force vector $F_i$ as force vector $F_i$ moves in response to a change in hardness of the subterranean earthen materials, and other disturbing forces. The size of the sliding surface should also be selected so that the net radial imbalance force vector is directed toward a location corresponding to the sliding surface as the bit wears.

Figure 2A:
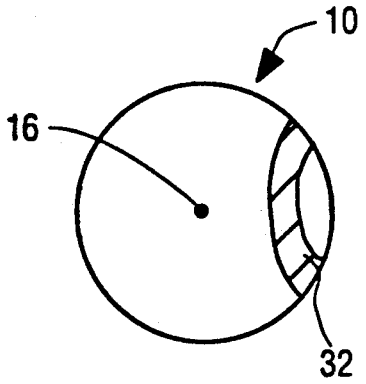
FIG. 2A shows a face or longitudinal view of the subterranean drill bit of FIGS. 1A and 1B having a sliding surface with a gauge profile.
Figure 2B:
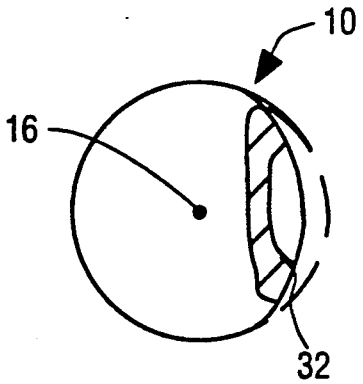
FIG. 2B shows a face or longitudinal view of the subterranean drill bit of FIGS. 1A and 1B having a sliding surface with an undergauge profile.
Figure 2C:
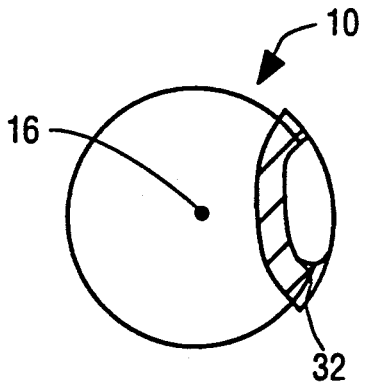
FIG. 2C shows a face or longitudinal view of the subterranean drill bit of FIGS. 1A and 1B having a sliding surface with an overgauge profile.

Several radial locations for sliding surface 32 are possible. For example, as shown in FIGS. 1B and 2A, sliding surface 32 is substantially circular and is located at a radial distance from bit axis 16 that is approximately equal to the gauge radius, i.e., the sliding surface is gauge. The sliding surface may also be located at a radial distance from the longitudinal bit axis that is less than the gauge radius, i.e., the sliding surface may be undergauge, as shown in FIG. 2B. alternatively, the sliding surface may be located at a radial distance from the bit axis that is greater than the gauge radius, i.e., the sliding surface may be overgauge, as shown in FIG. 2C.

Further in accordance with the invention, the subterranean drill bit includes a hydrostatic bearing disposed in the gauge portion, preferably at a location corresponding to the net radial imbalance force vector, for hydrostatically spacing the gauge portion from the borehole wall during the drilling. The hydrostatic bearing preferably is disposed on the gauge portion of the drill bit body about a force plane formed by the intersection of the bit axis and the net radial imbalance force vector for hydrostatically spacing the gauge portion from the borehole wall during the drilling. Preferably, the hydrostatic bearing comprises a recessed area and a flow port, and is operatively coupled in fluid communication with the flow channel in the drill bit body. The hydrostatic bearing does not necessarily comprise a separate bearing surface, such as a pad, built-up area, or the like, although these can be included.

The hydrostatic bearing provides a defined area of fluid to create a hydrostatic fluid bearing that pushes the drill bit body away from the borehole wall. This counteracts the net radial imbalance force, and reduces the frictional forces between the drill bit body and the borehole wall. The reduction in friction also reduces wear on the sliding surface, and reduces the tendency of the rotating drill bit to backwards whirl.

Figure 3A:
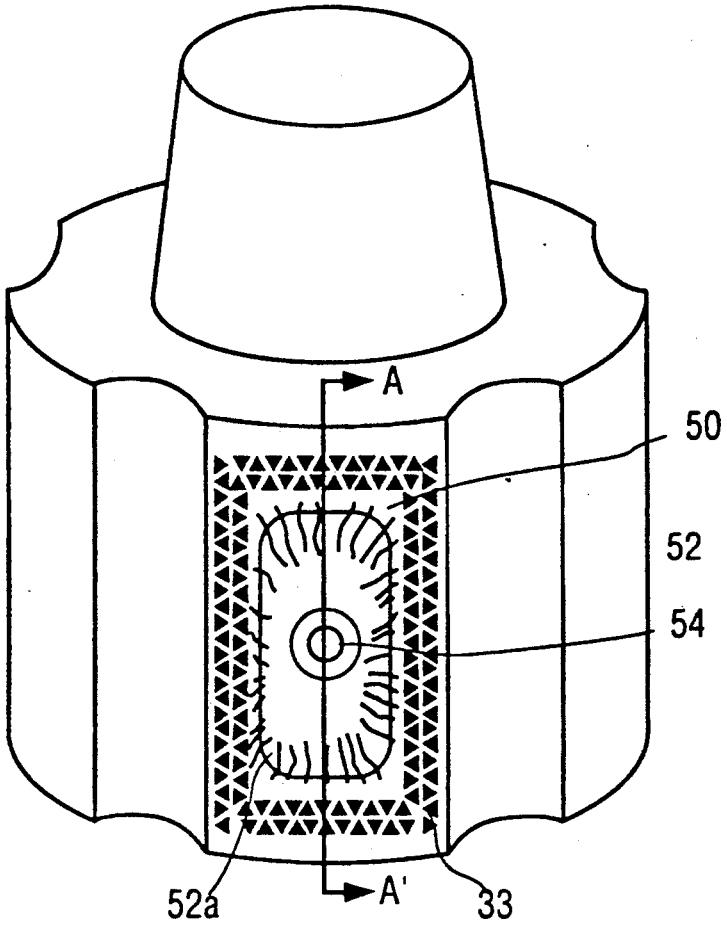
FIG. 3A shows a perspective view of the body portion of a subterranean drill bit similar to the one shown in FIGS. 1A and 1B in which the hydrostatic bearing is directed outward from the drawing sheet.

As applied to the preferred embodiment, the hydrostatic bearing of drill bit 10, designated by reference numeral 50, comprises a recessed area 52 disposed within sliding surface 32. Recessed area 52 can be forged or otherwise formed into gauge portion 18 of the drill bit body, or it can be machined into the drill bit body. The shape and size of recessed area 52 will depend on the specific drill bit and application. Recessed area 52 is shown in FIG. 3A as being substantially rectangular, but it may take other forms, provided the total radial force exerted by the hydrostatic bearing equals or exceeds the magnitude of the net radial imbalance force vector, or the appropriate component of this vector. Recessed area 52 as shown in FIG. 3A is centered with respect to, and extends approximately 75% of the longitudinal length of, gauge portion 18 along bit axis 16. It extends approximately 75-80% of the circumferential distance of sliding surface 32. Recessed area 52 is centered within sliding surface 32, and is centered circumferentially with respect to the location on gauge portion 18 that corresponds to the equilibrium direction of the net radial imbalance force vector. A plurality of grooves **52*a* are disposed in recessed area 52** and extend outward from it to promote the removal of rock flour, drilling mud or other fluid, and other debris. See FIG. 3A.

Figure 3B:
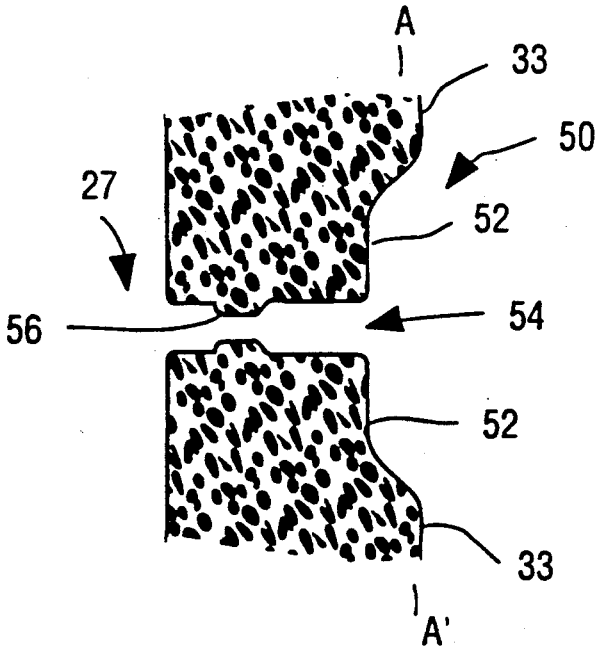
FIG. 3B shows a cross sectional cut-away view of the hydrostatic bearing shown in FIG. 3A taken along lines A—A of FIG. 3A.

Hydrostatic bearing 50 also includes a pressure or flow port 54 that is in fluid communication with flow channel 27 to supply a fluid such as drilling mud to recessed area 52. According to this design, the provision of drilling mud through the drillstring bore by known means results in pressurized fluid being distributed both to nozzles **27*a* and to flow port 54. As shown in FIG. 3B, a flow restrictor 56 such as a venturi or weir type restriction is disposed in flow port 54 to regulate the fluid flow rate to recessed area 52**.

Figure 4:
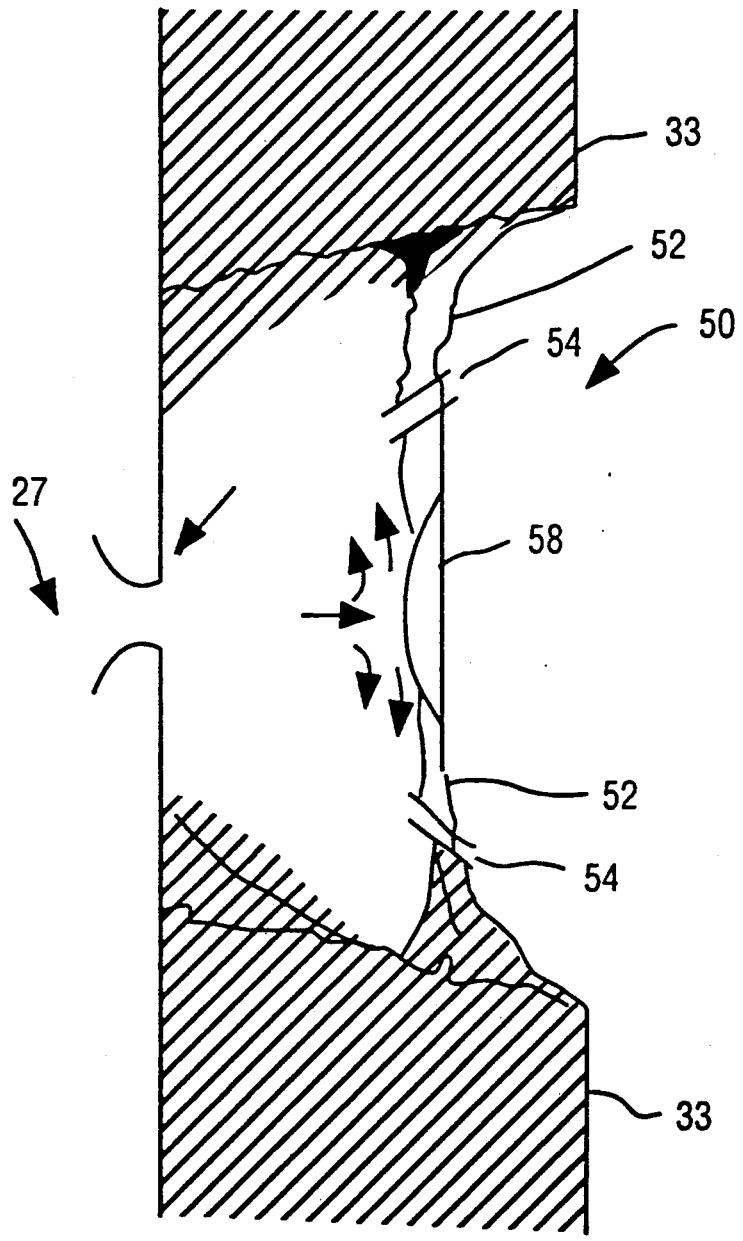
FIG. 4 shows a cross-sectional cut-away view of a modification of the hydrostatic bearing shown in FIG. 3B to include a diffuser.

FIG. 4 shows a modification of hydrostatic bearing 50 in which a diffuser 58 is rigidly disposed in the recessed area at flow port 54 to diffuse the fluid and limit fluid impingement on the wall of the wellbore. Diffuser 58 comprises a wear resistant material, such as tungsten carbide, and it is shaped to diffuse fluid flow without causing significant adverse effects on fluid pressure at recessed area 52. For example, a suitable design for diffuser 58 would lower fluid velocity, which would limit fluid erosion of the wall of the wellbore, thereby increasing pressure in recessed area 52 and increasing the hydrostatic lubricating effect.

Figure 5:
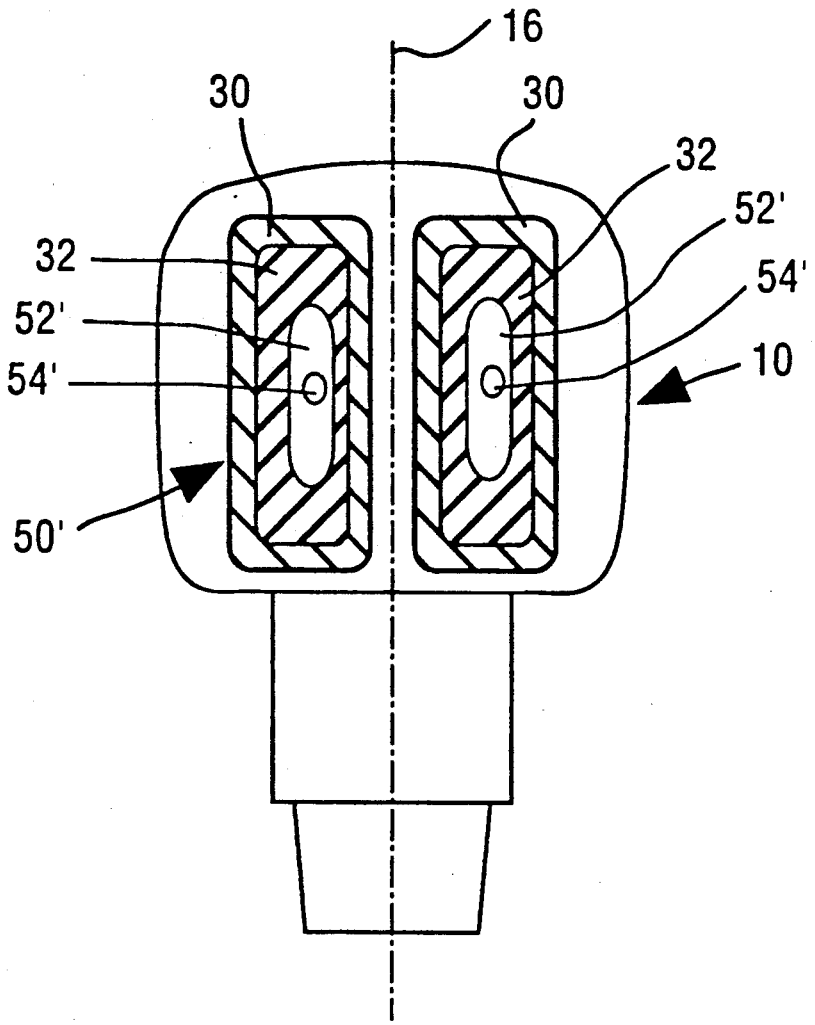
FIG. 5 shows a modification of the drill bit of the preferred embodiment in which the hydrostatic bearing comprises a plurality of recessed areas.

The hydrostatic bearing of the preferred embodiment as shown in FIGS. 1A and 1B comprises a single recessed area, but this is by way of illustration and not limitation. For example, a hydrostatic bearing 50' that comprises two recessed areas 52' and two flow ports 54' similar to those of FIG. 3A is shown in FIG. 5. This principle of providing a plurality of recessed areas and flow ports can be extended to greater numbers, depending on the drill bit design and application.

An appreciation for the invention and its corresponding advantages is facilitated by an understanding of the various forces acting on the drill bit during drilling, and the relationship of these forces to a new theory of fixed cutter subterranean drill bit failure related to backwards bit whirl, as recently discovered.

Figure 6A:
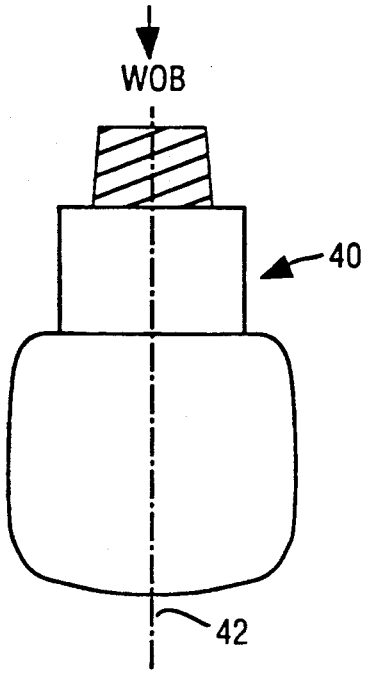
FIG. 6A shows a side view of a subterranean drill bit.

The principal forces acting on a subterranean drill bit as it drills through subterranean earthen materials include a drilling torque, the weight-on-bit, a radial imbalance force $F_{ri}$, a circumferential imbalance force $F_{ci}$, and a radial restoring force. With reference to FIG. 6A, the weight-on-bit is a longitudinal or axial force applied by the rotational drive source (drillstring) that is directed toward the face portion of the bit. Subterranean drills are often subject to weight-on-bit loads of 10,000 lbs or more. Circumferential imbalance force $F_{ci}$ and radial imbalance force $F_{ri}$ are radial forces in a radial plane perpendicular to the longitudinal bit axis, i.e., in the radial or lateral dimension of the bit body. An example of the radial plane corresponds to the plane of the drawing sheet for FIGS. 1B and 6B through 6D.

Figure 6B:
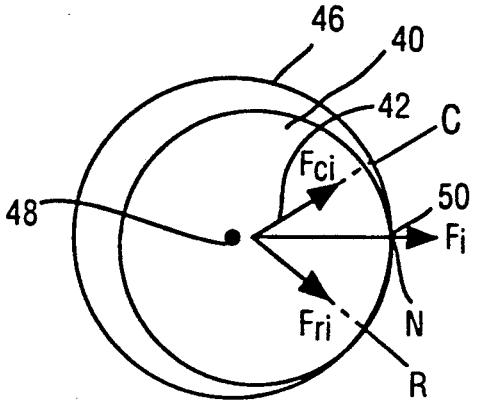
FIG. 6B shows a face or longitudinal view of a subterranean drill bit rotating in a borehole for purposes of illustrating the forces acting on the bit.

The radial imbalance force component or vector $F_{ri}$ is the radial component of the force created on the drill bit when the bit is loaded in the axial direction. The magnitude and direction of force vector $F_{ri}$ is independent of the speed of rotation of the bit, and instead is a function of the shape of the drill bit, the location, orientation, and shape of the cutting elements, the physical properties of the subsurface formation being drilled, and the weight-on-bit. The location, orientation, and shape of the cutters, however, usually are the factors most amenable to control. Force vector $F_{ri}$ is perpendicular to the longitudinal bit axis and intersects with a longitudinal projection of the gauge circumference at a point R, as shown in FIG. 6B. If the drill bit and its cutting elements are perfectly symmetrical about the longitudinal bit axis and if the weight on the bit is applied directly along the bit axis, then the radial imbalance force $F_{ri}$ will be zero. However, in the preferred embodiment, the drill bit and cutting elements are shaped and positioned so that a non-zero force $F_{ri}$ is applied to the drill bit when the bit is axially loaded. The force $F_{ri}$ can be substantial, up to thousands of pounds.

Figure 6C:
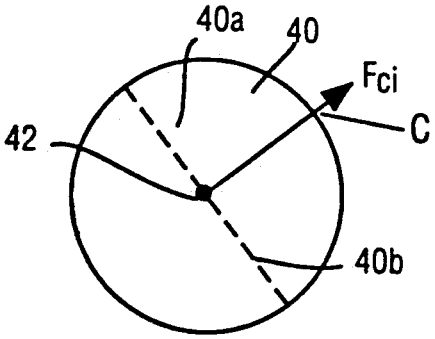
FIG. 6C shows a face or longitudinal view of a subterranean drill bit for purposes of illustrating the circumferential imbalance force on the drill bit.

The circumferential imbalance force component or vector $F_{ci}$ is the net radial component in the radial plane, obtained by vectorially summing the forces attributable to the interaction of the drill bit, primarily the individual cutting elements, with the borehole bottom and walls as the bit rotates. This circumferential imbalance force can be represented as a vector $F_{ci}$ (as shown in FIGS. 6B and 6C) which passes through the longitudinal bit axis and intersects with a longitudinal projection of the gauge circumference at point C on the longitudinal projection of FIG. 6A. As explained below, the circumferential imbalance force $F_{ci}$ can vary, depending upon both the design of the drill bit (shape of the bit and shape and positioning of cutting elements), the operation of the drill bit, and the earthen materials being drilled.

For example, FIG. 6C shows a longitudinal view of a drill bit 40 having a plurality of cutting elements disposed on the face portion of the bit body to create a pair of linear cutting blades 40*a* and 40*b* symmetric with respect to one another. If such a bit rotates about the bit axis, and if cutting blades 40*a* and 40*b* cut a homogeneous material so they experience symmetric forces, the respective blades will correspond to a force couple or torque with zero net force directed away from the bit axis. If, however, cutting blades 40*a* and 40*b* are not perfectly symmetric, or if they cut heterogeneous material so they experience different or asymmetric forces, the respective blades will create both a torque about a center of rotation displaced from the bit axis and a non-zero net circumferential imbalance force F in the radial dimension toward the point C on the projection of the bit. Subterranean drill bits usually create a non-zero circumferential imbalance force $F_{ci}$. As will be explained in greater detail below, drill bit 10 is intentionally designed to create a substantial circumferential imbalance force $F_{ci}$.

The circumferential imbalance force vector $F_{ci}$ and the radial imbalance force vector $F_{ri}$ combine to create the net radial force vector $F_i$ which is substantially perpendicular to the longitudinal bit axis and which intersects with a longitudinal projection of the gauge circumference at a point N (FIG. 6B). This force point N indicates the point or region on a projection of the gauge circumference corresponding to the portion of the drill bit body that contacts the borehole wall in response to the net radial imbalance force vector $F_i$ at a given time. Given the geometries of the drill bit body and the borehole wall, the gauge portion of the drill bit body will contact the borehole wall. The hydrostatic bearing is disposed on the drill bit body at a location that corresponds to this contacting portion of the drill bit body to provide the radial restoring force required to balance force vector $F_i$.

Figure 6D:
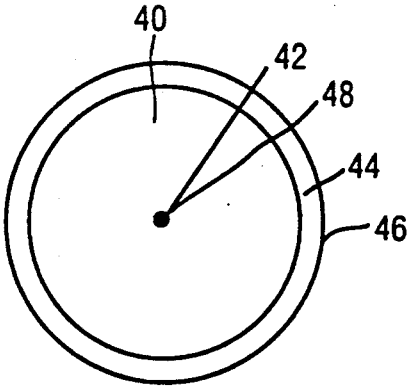
FIG. 6D shows a face or longitudinal view of a subterranean drill bit rotating in a borehole wall for purposes of illustrating static stability.

An appreciation of the invention is further facilitated by an understanding of the concepts of static and dynamic stability as they apply to low friction drill bits in accordance with the invention. Statically stable bit rotation, as the term is used in this document, can be defined as a condition in which the center of rotation of the drill bit stays at the fixed point on the drill bit surface in the absence of a disturbing force or a formation heterogeneity. For example, FIG. 6D shows a drill bit 40 with a longitudinal bit axis 42 similar to bit axis 16. Drill bit 40 rotates in a borehole 44 having a cylindrical borehole wall 46. The center of borehole 44 is designated by reference numeral 48. Because drill bit 40 rotates about a fixed center of rotation on the bit surface, i.e., longitudinal bit axis 42, the rotation is statically stable. A condition in which drill bit 40 is rotated about a fixed point on the drill bit surface, but in which this center of rotation on the drill bit is not co-located with borehole center 48, would also be considered statically stable rotation. Statically stable bit rotation is usually accompanied by a net radial imbalance force vector $F_i$ that has a substantially constant magnitude and direction relative to the drill bit body. The direction of this constant force vector $F_i$ can be considered an equilibrium direction.

Dynamic stability, as the term is used in relation to low friction subterranean drill bits in accordance with the invention, refers to a condition in which the net radial imbalance force vector $F_i$ returns to an equilibrium direction in response to a disturbing displacement. The disturbing displacement may be caused by a number of factors, such as the encountering of a change in subterranean earthen material hardness, the off axis movement of the drill bit itself, and drillstring vibrations.

A subterranean drill bit may have static stability, i.e., net radial imbalance force vector $F_i$ may be directed to an equilibrium direction, but fail to have dynamic stability, i.e., a disturbing displacement will move force vector $F_i$ away from the equilibrium direction and force vector $F_i$ will not return to the equilibrium direction upon relaxation, as explained in greater detail below.

The new theory of subterranean drill bit failure noted above, referred to as the backwards bit whirl theory, will now be Described. A more complete description of the theory is provided in J. F. Brett, T. M. Warren, and S. M. Behr, "Bit Whirl: A New Theory of PDC Bit Failure," Society of Petroleum Engineers, (SPE) 19571, presented at the 64th Annual Technical Conference of the SPE, San Antonio, TX, Oct. 8-11, 1989.

It has long been known, and research continues to support the proposition, that optimal penetration rates and drill bit lifetimes are achieved when the rotation of the drill bit is statically stable about the longitudinal bit axis, and when the cutting edges of the cutting elements are not chipped or broken. Although some chipping and war of the cutting elements is unavoidable, they are quite durable under stable bit rotation conditions, and the diamond cutting edges can be regenerated to some extent with continued drilling because the carbide supports that extend beyond the cutting edge of the chipped cutter will wear faster than the diamond. Once chipping of the diamond occurs, however, the performance of the drill bit drops significantly.

Through an extensive research effort, the present inventors have discovered that a majority of cutter damage and the corresponding drill bit failure apparently is caused by impact damage attributable to a subterranean drilling phenomenon termed backwards whirl. Backwards whirl is defined as a condition in which the center of rotation of the drill bit moves on the bit surface as the bit rotates. The phenomenon of backwards whirl can be explained with reference of FIGS. 6B and 6D.

FIG. 6B illustrates a condition in which drill bit 40 has been moved by net radial imbalance force $F_i$ radially on the bit to a position in which the drill bit contacts borehole wall 46 at a contact point 50 corresponding to force point N. If the net radial imbalance force vector $F_i$ becomes large enough to force the surface of the bit body against the borehole wall, and if frictional or cutting forces prevent the drill bit surface contacting the borehole wall from sliding on the borehole wall essentially without friction, contact point 50 becomes the instantaneous center of rotation for the drill bit. For example, the instantaneous center of rotation of the drill bit may move from the longitudinal bit axis toward contact point 50 at or near the gauge portion of the drill bit body. This new frictional force between the drill bit body surface and the borehole wall, which is caused or accentuated in conventional subterranean drill bits by the gauge cutters around the gauge portion of the bit, causes the instantaneous center of rotation of the bit to continue to move around the face portion of the bit, away from the longitudinal bit axis and toward the borehole wall, as the bit rotates.

When a drill bit begins to whirl, the cutting elements can move backwards, sideways, etc. They move further per revolution than those on a bit instable rotation, and they move faster. As a result, the cutters are subjected to high impact loads when the drill bit impacts the borehole wall, which occurs several times per bit revolution for a whirling bit. These impact forces chip and break the cutters. Once backwards whirl begins, it regenerates itself.

An object of the present invention is to provide a drill bit that overcomes the problems presented by backwards whirl of a subterranean drill bit. The subterranean drill bit of the present invention overcomes the undesirable effects of backwards whirl by providing a hydrostatic bearing the creates little or no friction between the drill bit body and the borehole wall. The cutter devoid region and sliding surface also minimize frictional forces, such as those attributable to gauge cutters, from causing the drill bit to grip or dig into the borehole wall and move the instantaneous center of rotation of the drill bit.

The cutting elements preferably are disposed to cause the net radial imbalance force vector $F_i$ to substantially maintain the hydrostatic bearing at the borehole wall during the drilling, but small enough to avoid overcoming the force of the hydrostatic bearing the pushing the drill bit body away from the borehole wall. Ideally, this condition would hold throughout the operation of the drill bit. The cutting elements preferably are disposed to cause the net radial imbalance force vector $F_i$ to have an equilibrium direction. The features in which the cutting elements are disposed to cause then et radial imbalance force vector to have a magnitude and direction to substantially maintain the hydrostatic bearing at the borehole wall during the drilling, and to cause the net radial imbalance force vector to have an equilibrium direction, are related to the static stability of the drill bit.

The magnitude of the net radial imbalance force vector $F_i$ preferably is in the range of about 3% to 40% of the applied weight-on-bit load. For example if the weight-on-bit load is 10,000 pounds, the $F_i$ should be within the range of 300 to 4,000 pounds. If the drill bit is designed for relatively low weight-on-bit, the magnitude of force vector $F_i$ should be relatively high, and vice versa. If the drill bit is designed for relatively high RPM, a somewhat greater magnitude of force vector $F_i$ is needed. If a relatively large drill bit is used, the magnitude of force vector $F_i$ should be decreased.

The inventors have found that the drill bit of the invention can be further refined by specifically positioning the cutting elements (including selecting the drill bit body shape and design) not only to control the direction and magnitude of net radial imbalance force vector $F_i$ but also of the individual force components making up the force vector $F_i$, i.e., circumferential imbalance force vector $F_{ci}$ and radial imbalance force vector $F_{ri}$. More specifically, drill bit performance has shown improvement by positioning the face and gauge cutting elements so that at least one of force vectors $F_{ci}$ and $F_{ri}$ is directed to a location corresponding to the hydrostatic bearing at all times during the operation of the bit. Additional stability can be achieved by designing the drill bit shape and positioning the face and gauge cutters so that force vectors $F_{ci}$ and $F_{ri}$ are approximately aligned with each other and with the resultant net radial imbalance force vector $F_i$.

The cutting elements preferably are disposed to cause net radial imbalance force vector $F_i$ to substantially return to the equilibrium position in response to a disturbing displacement, preferably for disturbing displacements or offsets of up to 75 thousandths of an inch. This feature of the invention is related to the dynamic stability of the drill bit.

Figure 7A:
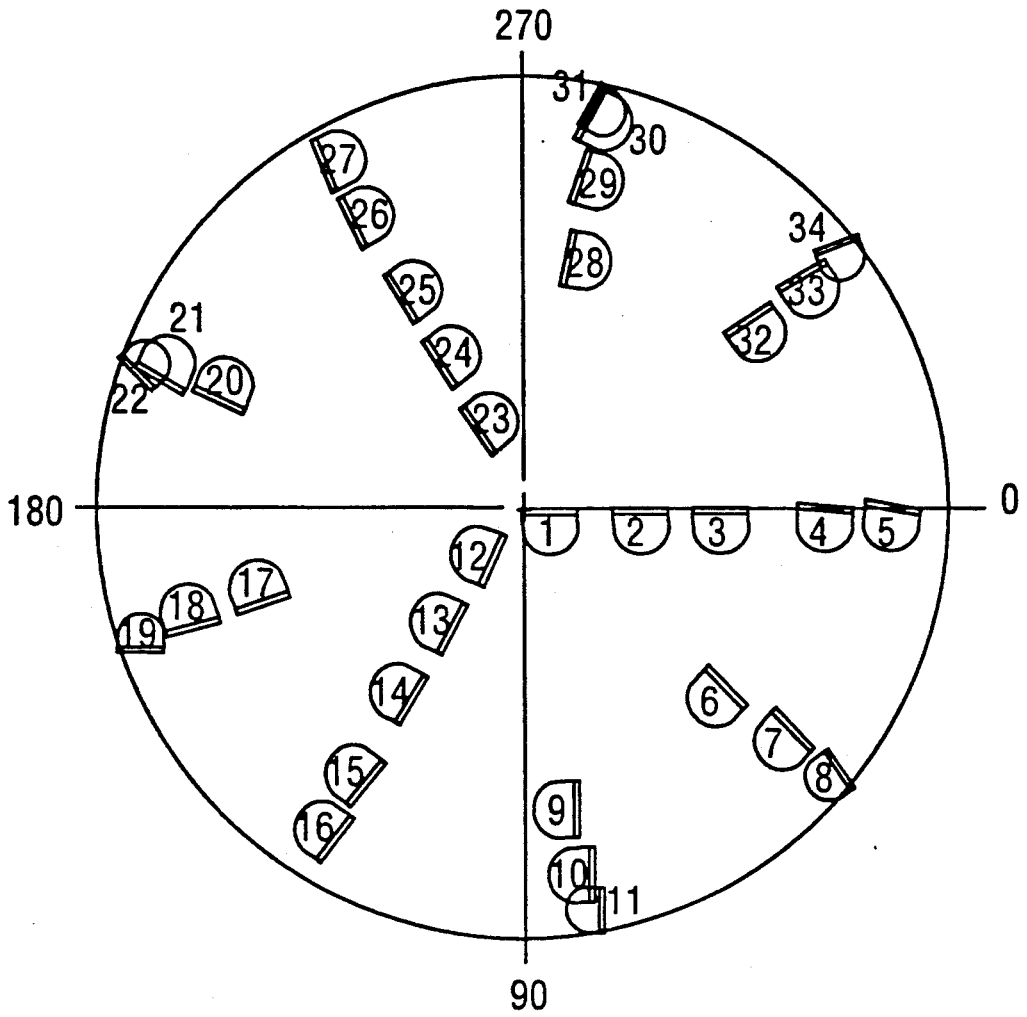
FIG. 7A shows a face or longitudinal view of a subterranean drill bit made according to a known design.
Figure 7B:
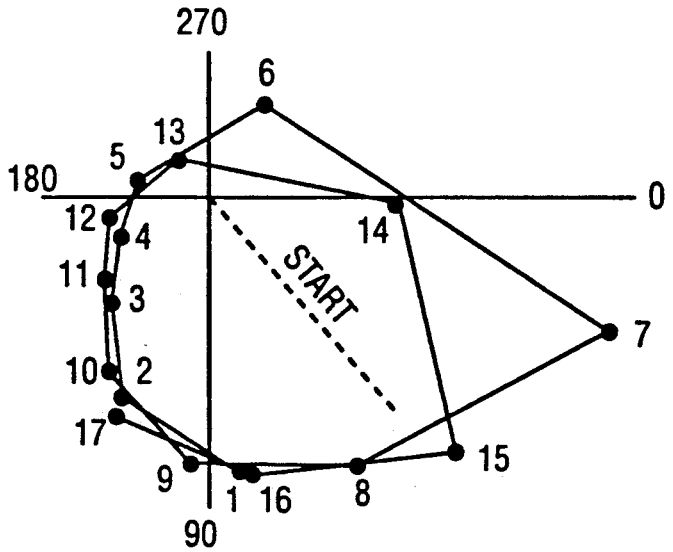
FIG. 7B shows a plot of the net radial imbalance force vector $F_i$ for the drill bit of FIG. 7A
Figure 8A:
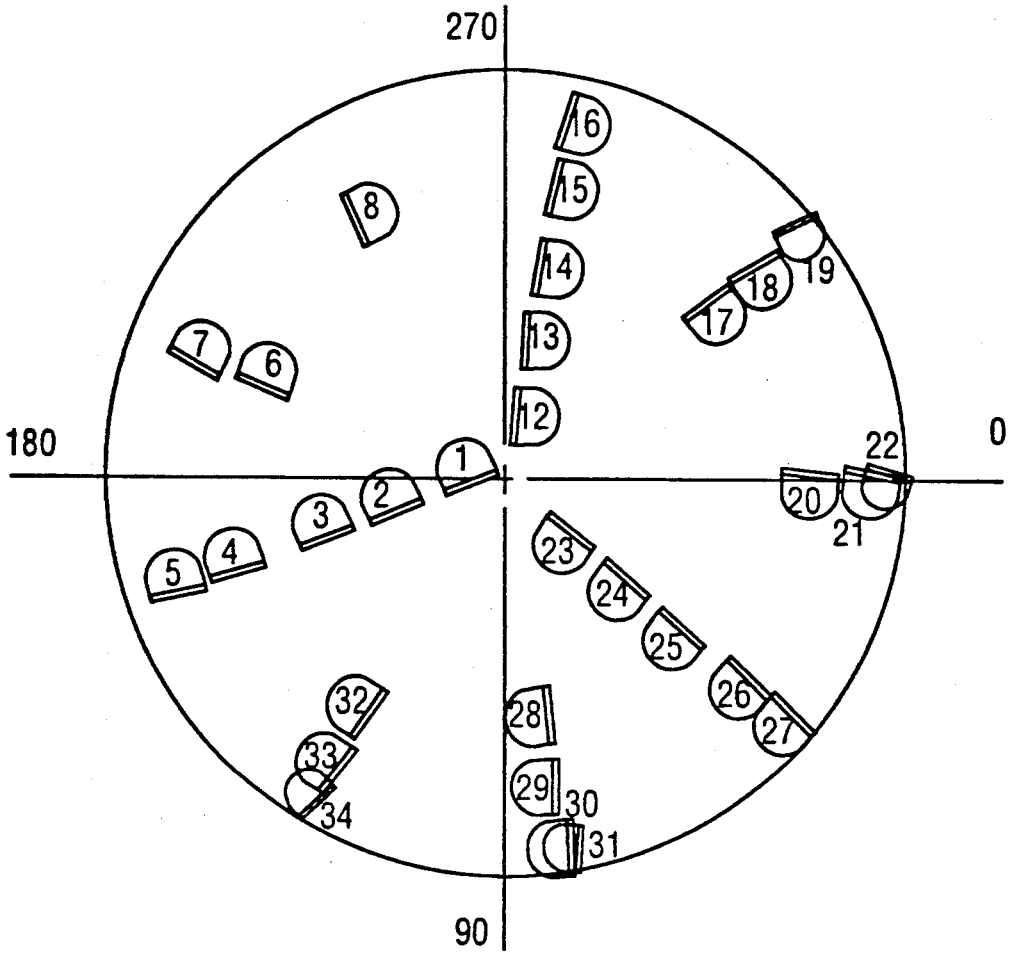
FIG. 8A shows a face or longitudinal view of a subterranean drill bit in accordance with the invention.
Figure 8B:
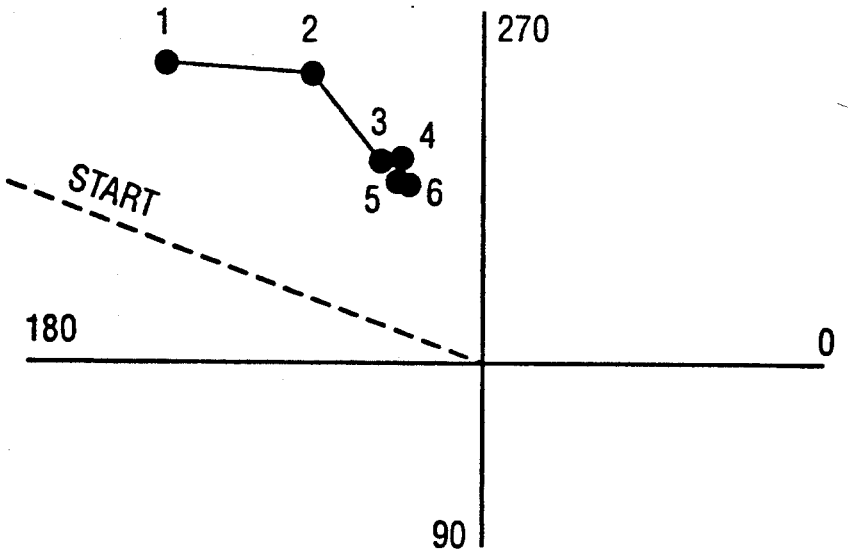
FIG. 8B shows a plot of the net radial imbalance force vector for the drill bit of FIG. 8A.

The magnitude and direction of net radial imbalance force vector $F_i$ for an operational subterranean drill bit will change as the bit operates. This movement may be caused by the factors above, such as heterogeneity of the subterranean earthen materials to be drilled. The lack of dynamic stability can cause force vector $F_i$ to move away from the hydrostatic bearing in response to a disturbance, and either converge to a new equilibrium position away from the hydrostatic bearing or become dynamically unstable, in which case force vector $F_i$ can continue to move as further drilling occurs. To illustrate, FIG. 7A shows a longitudinal view of a subterranean drill bit made according to a known design, and FIG. 8A shows a longitudinal view of a subterranean drill bit in which cutters 8, 10 and 11 have been removed to provide a low friction bit in accordance with the invention. Table 1 gives the offset, offset direction, imbalance force direction, net radial imbalance force direction, and net radial force imbalance magnitude for the drill bit of FIG. 7A. Table 2 shows corresponding data for the low friction bit of FIG. 8A. Offset here refers to the radial distance that the drill bit center of rotation is moved corresponding to a disturbing displacement during drilling. The offset direction refers to the radial direction of the disturbing displacement. FIGS. 7B and 8B are plots of net radial imbalance force vector $F_i$ (direction and magnitude) shown in Tables 1 and 2, respectively.

TABLE 1

NET RADIAL IMBALANCE FORCE VECTOR v. OFFSET FOR DYNAMICALLY UNSTABLE DRILL BIT

| Offset | Initial Offset Direction | Imbalance Force Direction | Imbalance Magnitude (pounds) |
|---|---|---|---|
| 0" | 0° | 56° | 1300 |
| 0.030" | 56 | 83 | 1746 |
| | 83 | 91 | 1412 |
| | 91 | 94 | 1302 |
| | 94 | 87 | 1101 |
| | 87 | 93 | 1352 |
| | 93 | 94 | 1302 |
| 0.050" | 56° | 85° | 2070 |
| | 85 | 108 | 1600 |
| | 108 | 126 | 946 |
| | 126 | 149 | 607 |
| | 149 | 192 | 453 |
| | 192 | 292 | 630 |
| | 292 | 22 | 2480 |
| | 22 | 66 | 2267 |
| | 66 | 92 | 2028 |
| | 92 | 114 | 1459 |
| | 114 | 134 | 857 |

TABLE 1-continued

NET RADIAL IMBALANCE FORCE VECTOR v. OFFSET FOR DYNAMICALLY UNSTABLE DRILL BIT

| Offset | Initial Offset Direction | Imbalance Force Direction | Imbalance Magnitude (pounds) |
|---|---|---|---|
| | 134 | 164 | 542 |
| | 164 | 231 | 428 |
| | 231 | 352 | 968 |
| | 352 | 48 | 2552 |
| | 48 | 82 | 2101 |
| | 82 | 106 | 1789 |

TABLE 2

NET RADIAL IMBALANCE FORCE VECTOR v. OFFSET FOR DYNAMICALLY STABLE DRILL BIT

| Offset | Initial Offset Direction | Imbalance Force Direction | Imbalance Magnitude (pounds) |
|---|---|---|---|
| 0" | 0° | 204° | 1189 |
| 0.030" | 204° | 227° | 1753 |
| | 227 | 236 | 1405 |
| | 236 | 235 | 1322 |
| | 235 | 235 | 1322 |
| 0.050" | 204° | 229 | 2111 |
| | 229 | 244 | 1733 |
| | 244 | 250 | 1224 |
| | 250 | 252 | 1124 |
| | 252 | 252 | 1031 |

The dill bit of FIG. 7A demonstrates dynamic stability at an offset displacement of 0.030 inches and an initial offset direction of 56°. The net radial imbalance force vector $F_i$ has a stable direction and magnitude. The drill bit of FIG. 7A becomes and remains unstable, however, for an offset of 0.050 inches and the same initial offset direction of 56°.

The drill bit of FIG. 8A, in contrast, remains both statically and dynamically stable for offsets of both 0.030 inches and 0.050 inches and an initial offset direction of 204°. Although the direction of net radial imbalance force vector $F_i$ changes after the disturbing displacement in each case, the direction of force vector $F_i$ is substantially toward an equilibrium direction, and still toward a location corresponding to the hydrostatic bearing.

Drill bit 10 (FIG. 1A) provides dynamic stability by making sliding surface 32 and hydrostatic bearing 50 of sufficient size to encompass the net radial imbalance force vector as the net radial imbalance force vector moves in response to changes in hardness of the subterranean earthen materials, and by positioning the cutting elements to minimize the variations in the direction of force vector $F_i$. If the sliding surface and hydrostatic bearing are not sufficiently large to create this condition, backwards whirling can occur. Through experimentation, the inventors have found that the sliding surface preferably should extend over the least 20%, and most preferably over 50 to 60%, of the gauge circumference. The sliding surface can extend over as much as 90% of the gauge circumference without adversely affecting the ability of the bit to sufficiently drill. As a general rule of thumb, the circumferential length of the sliding surface should correspond to the expected range of movement of force vector $F_i$, plus up to about 20% on either side of this range of movement.

Having described the preferred embodiment of the invention, the preferred method of the invention will now be described. For clarity and ease of illustration, the preferred method will be described with reference to the preferred embodiment of the invention, although the method is not necessarily limited to this embodiment.

The method of the invention comprises providing a subterranean drill bit that includes a drill bit body having a base portion disposed about a longitudinal bit axis, a gauge portion disposed about the bit axis and extending from the base portion, a face portion disposed about the bit axis extending from the gauge portion, and an internal fluid flow channel. The drill bit also includes a plurality of cutting elements fixedly disposed on and projecting from the face portion and spaced from one another, preferably to create a net radial imbalance force during the drilling along a net radial imbalance force vector approximately perpendicular to the bit axis. The drill bit further includes a hydrostatic bearing disposed in the gauge portion.

In accordance with the preferred method, this aspect of the invention may be carried out by providing a subterranean drill bit such as drill bit 10 described above, including drill bit body 12, base portion 14, gauge portion 18, face portion 20, flow channel 27, cutting elements 24 and 26, and hydrostatic bearing 50.

Method further includes rotating the drill bit which, in accordance with the preferred method, may comprise rotating the drill bit by known means.

As the drill bit is rotated, the net radial imbalance force vector is directed radially outward toward the hydrostatic bearing. This vector can be projected onto gauge circumference when the drill bit is viewed longitudinally as shown in FIG. 1B.

Figure 9:
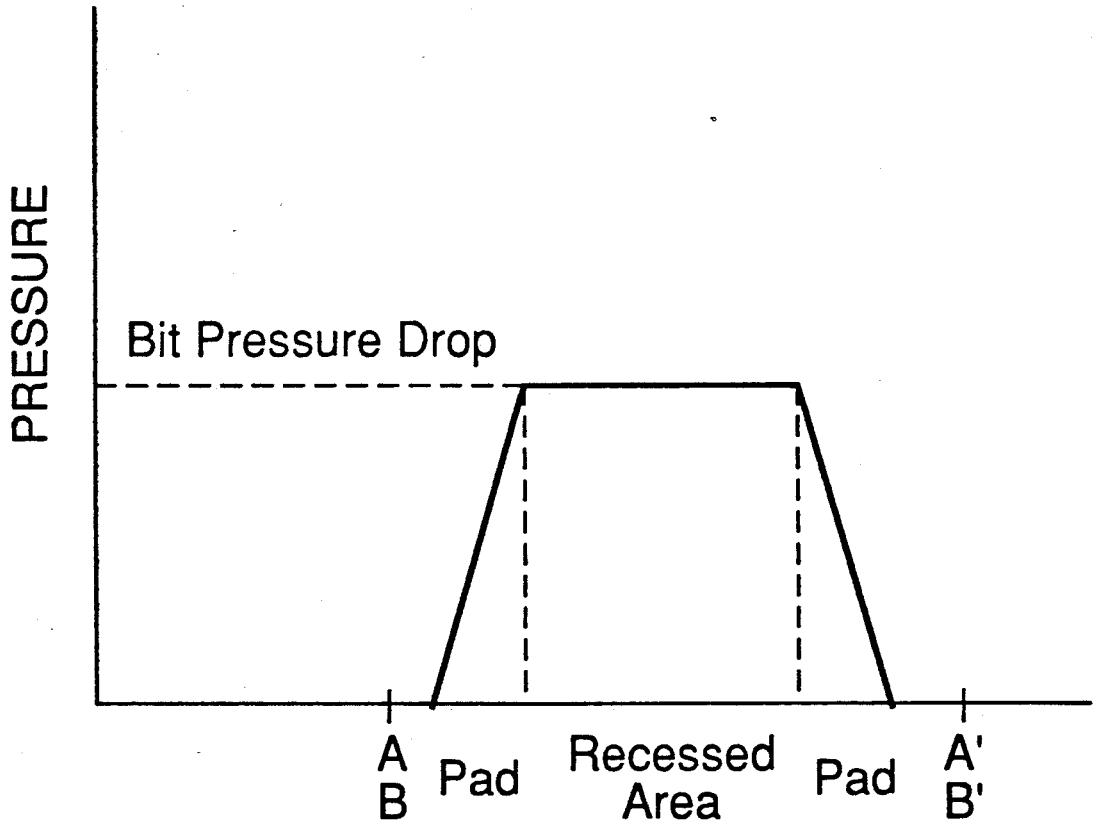
FIG. 9 shows a graph of pressure versus position within the recessed area of the hydrostatic bearing shown in FIG. 3A taken along a line down the center of the bearing contiguous with the sliding surface and parallel to the longitudinal bit axis.

The method of the invention further includes pressurizing as fluid in the flow channel and forcing the fluid out the hydrostatic bearing toward the borehole wall. In accordance with the preferred method, the fluid pressurizing step comprises pressurizing drilling mud in the drillstring bore of the drillstring to which the drill bit is attached, which forces the drilling mud out the flow port of the hydrostatic bearing toward the borehole wall. As pressurized fluid is forced out the flow port, a hydrostatic bearing comprising a fluid film is created between the drill bit body and the borehole wall. This hydrostatic bearing moves sliding surface 32 of the drill bit body away from the borehole wall. The hydrostatic bearing is designed in conjunction with the net radial imbalance force vector $F_i$ so that the force created by the bearing opposes and overcomes the force corresponding to the net radial imbalance force. The magnitude of inward force on the drill bit produced by the hydrostatic bearing can be obtained by determining the pressure profile of the recessed area, i.e., the pressure as a function of position in the recessed area, as shown in FIG. 9, and integrating this pressure profile over the pressurized area.

The cutter devoid region and sliding surface operate in conjunction with the hydrostatic bearing to prevent frictional forces, such as those attributable to gauge cutters, from causing the gauge portion of the drill bit to engage the borehole wall. Should contact occur, the sliding surface provides a low friction bearing zone that contacts the slides on the borehole wall without engaging it.

Having described the preferred embodiment and method, additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A subterranean rotary drill bit comprising:

a rotary drill bit body having a base portion disposed about a longitudinal bit axis, a gauge portion disposed about the bit axis and extending from the base portion, and a face portion disposed about the bit axis extending from the gauge portion;

a plurality of cutting elements fixedly disposed on and projecting from the face portion and spaced from one another; and a hydrostatic bearing means disposed in the gauge portion for forcing drilling fluid out the hydrostatic bearing means towards a borehole wall.

2. A subterranean rotary drill bit as recited in claim 1, wherein the hydrostatic bearing comprises a recessed area and a fluid flow port.

3. A subterranean rotary drill bit as recited in claim 1, wherein the rotary drill bit body includes an internal fluid flow channel, and the hydrostatic bearing is operatively coupled in fluid communication with the flow channel.

4. A subterranean rotary drill bit as recited in claim 1, wherein the hydrostatic bearing includes a diffuser.

5. A subterranean rotary drill bit for drilling in subterranean earthen materials to create a borehole having a borehole wall, the rotary drill bit comprising:

a rotary drill bit body having a base portion disposed about a longitudinal bit axis, a gauge portion disposed about the bit axis and extending from the base portion, and a face portion disposed about the bit axis and extending from the gauge portion, and an internal fluid flow channel a plurality of cutting elements fixedly disposed on and projecting from the face portion and spaced from one another to create a net radial imbalance force during the drilling along a net radial imbalance force vector substantially perpendicular to the bit axis; and a hydrostatic bearing means in fluid communication with the fluid flow channel and disposed in the gauge portion at a location corresponding to the net radial imbalance force vector for forcing drilling fluid out the hydrostatic bearing means toward a borehole wall during the drilling.

6. A subterranean rotary drill bit for drilling in subterranean earthen materials to create a borehole having a borehole wall, the rotary drill bit comprising:

a rotary drill bit body having a base portion disposed about a longitudinal bit axis, a gauge portion disposed about the bit axis and extending from the base portion, a face portion disposed about the bit axis and extending from the gauge portion, and an internal fluid flow channel a plurality of cutting elements fixedly disposed on and projecting from the face portion and spaced from one another to create a net radial imbalance force during the drilling along a net radial imbalance force vector substantially perpendicular to the bit axis; and a hydrostatic baring means in fluid communication with the fluid flow channel and disposed in the gauge portion about the force plane formed by the intersection of the bit axis and the net radial imbalance force vector for forcing drilling fluid out the bearing means toward a borehole wall during the drilling.

7. A subterranean rotary drill bit as recited in claim 6, further including a substantially continuous cutter devoid region disposed on the gauge portion at and about the hydrostatic bearing.

8. A method for drilling in subterranean earthen materials to create a borehole having a borehole wall, the method comprising:

(a) providing a subterranean rotary drill bit including, a rotary drill bit body having a base portion disposed about a longitudinal bit axis, a gauge portion disposed about the bit axis and extending from the base portion, a face portion disposed about the bit axis and extending from the gauge portion, an internal fluid flow channel, a plurality of cutting elements fixedly disposed on and projecting from the face portion and spaced from one another, and a hydrostatic bearing means in fluid communication with the fluid flow channel and disposed in the gauge portion for forcing fluid out the hydrostatic means toward a borehole wall.

(b) rotating the rotary drill bit; and (c) pressurizing a drilling fluid in the flow channel and forcing the drilling fluid out the hydrostatic bearing toward the borehole wall.

9. A method for drilling in subterranean earthen materials to create a borehole having a borehole wall, the method comprising:

providing a subterranean rotary drill bit including, a rotary drill bit body having a base portion disposed about a longitudinal bit axis, a gauge portion disposed about the bit axis and extending from the base portion, a face portion disposed about the bit axis and extending from the gauge portion, and an internal channel for channeling flow of a fluid, a plurality of cutting elements fixedly disposed on and projecting from the face portion and spaced from one another to create a net radial imbalance force during drilling along a net radial imbalance force vector substantially perpendicular to the bit axis, and a hydrostatic bearing means disposed in the gauge portion at the location corresponding to the net radial imbalance force vector and in fluid communication with the flow channel for forcing drilling fluid out the hydrostatic bearing means toward a borehole wall.

rotating the rotary drill bit; and pressurizing drilling fluid kin the flow channel and forcing the fluid out the hydrostatic bearing means toward the borehole wall.

* * * * *

UNITED STATES PATENT AND TRADEMARK OFFICE

CERTIFICATE OF CORRECTION

PATENT NO. : 5,111,892

DATED : May 12, 1992

INVENTOR(S) : Sinor, et al.

It is certified that error appears in the above-indentified patent and that said Letters Patent is hereby corrected as shown below:

| Col. | Line | |
|---|---|---|
| | | On the title page under "Inventors" please insert --Assignee: Amoco Corporation, Chicago, Illinois-- |
| 9 | 7 | "altenatively" should read --Alternatively-- |
| 10 | 65 | "shaped and..." should read --shaped and positioned-- |
| 12 | 31 | "Described" should read --described-- |
| 16 | 25 | "Method further..." should read --The method further-- |
| 18 | 52 | "at the location" should read --at a location-- |

UNITED STATES PATENT AND TRADEMARK OFFICE

CERTIFICATE OF CORRECTION

PATENT NO. : 5,111,892

DATED : May 12, 1992

INVENTOR(S) : Sinor, et al.

It is certified that error appears in the above-indentified patent and that said Letters Patent is hereby corrected as shown below:

| Col. | Line | |
|---|---|---|
| 18 | 58 | "fluid kin the flow channel" should read -- fluid **in** the flow channel-- |

Signed and Sealed this

Fourteenth Day of December, 1993

Bruce Lehman

*Attest:*

BRUCE LEHMAN

*Attesting Officer*

*Commissioner of Patents and Trademarks*